US006106196A

United States Patent [19]

Hantz, Jr. et al.

[11] Patent Number: 6,106,196

[45] Date of Patent: Aug. 22, 2000

[54] LIQUID DRAIN SYSTEM, COMPONENTS THEREFOR AND METHOD FOR USING SAME

[76] Inventors: Clyde Hantz, Jr., P.O. Box 5746, Lake Charles, La. 70606-5746; Jonathan P. Hantz, 440 Barbara Hill Dr., Ragley, La. 70657

[21] Appl. No.: 09/092,698

[22] Filed: Jun. 5, 1998

[51] Int. Cl.[7] ..... E02B 13/00

[52] U.S. Cl. ..... 405/52; 52/20; 405/80

[58] Field of Search ..... 405/52, 40, 41, 405/43, 45, 51; 52/20, 19, 21; 249/1, 9–13

[56] References Cited

U.S. PATENT DOCUMENTS

| | | | |
|---|---|---|---|
| 1,087,366 | 2/1914 | Haase . | |
| 1,120,478 | 12/1914 | Harper . | |
| 1,720,503 | 7/1929 | Wickey . | |
| 1,738,056 | 12/1929 | Hunter | 249/90 X |
| 1,814,738 | 7/1931 | Penote . | |
| 1,948,931 | 2/1934 | Mears . | |
| 2,650,411 | 9/1953 | Mitchell . | |
| 2,668,344 | 2/1954 | Killian et al. | 249/90 |
| 2,681,495 | 6/1954 | Killian et al. | 249/90 |
| 2,730,785 | 1/1956 | Williams et al. . | |
| 2,735,154 | 2/1956 | Killian et al. | 249/90 X |
| 3,136,024 | 6/1964 | Monica . | |
| 3,178,793 | 4/1965 | Rosengarten et al. | 249/90 X |
| 3,212,519 | 10/1965 | Paschen . | |
| 3,367,358 | 2/1968 | Rentschler | 249/90 X |
| 3,436,051 | 4/1969 | Nakahara . | |
| 3,562,969 | 2/1971 | Little . | |
| 3,695,153 | 10/1972 | Dorris . | |
| 3,715,958 | 2/1973 | Crawford et al. . | |
| 3,729,165 | 4/1973 | Trimble . | |
| 3,788,080 | 1/1974 | Washabaugh et al. . | |
| 3,860,214 | 1/1975 | Schmidgall . | |
| 3,938,285 | 2/1976 | Gilbu . | |
| 4,123,034 | 10/1978 | Crunk et al. . | |
| 4,127,990 | 12/1978 | Morrow . | |
| 4,340,081 | 7/1982 | Watson | 405/41 X |
| 4,882,882 | 11/1989 | Werner . | |
| 5,645,372 | 7/1997 | Hahn . | |

FOREIGN PATENT DOCUMENTS

| | | | |
|---|---|---|---|
| 406010367 | 1/1994 | Japan | 52/20 |

*Primary Examiner*—Dennis L. Taylor
*Attorney, Agent, or Firm*—Browning Bushman

[57] ABSTRACT

A first molding is provided for forming from concrete a drain component housing having a fluid channel therethrough, preferable having an exterior lateral dimension smaller than or equal to the O.D. of the drain pipe used in the system. After locating the drain pipe, and exposing its top surface, a drain hole is cut into the top surface without severing the drain pipe. The drain component housing is then placed over the drain hole, and mortared in place, providing a water-tight seal. If the drain component housing does not reach the earth's surface being drained, a riser drain housing is stacked on top of the lower housing to provide the desired height. A second mold is provided for pouring the riser housing from concrete, the riser housing also having a fluid channel therethrough.

18 Claims, 7 Drawing Sheets

LIQUID DRAIN SYSTEM, COMPONENTS THEREFOR AND METHOD FOR USING SAME

FIELD OF THE INVENTION

The present invention relates, generally, to a system for draining liquid from various sources, for example, from automobile parking lots, grass lawns, highways and streets, and the like, and more particularly, to a system using small, light-weight, portable components which can be easily tapped into a drain pipe without the necessity, in most cases, of providing any additional support under the drain pipe itself.

BACKGROUND OF THE BACKGROUND

Liquid drain systems have existed in various forms since perhaps the beginning of time, the most common system in use today probably involving the drain of excess rain water, for example, into large diameter catch basins used to drain rain water from city streets.

In the U.S. Pat. No. 3,715,958 to David D. Crawford et al, a preformed manhole body is described and illustrated as having a large bodied catch basin 2 purposely made with a larger diameter than the diameter of the sewer pipe, to enable its use as a basin having notched openings 10 which fit over a sewer pipe 18. As can be seen in FIGS. 7–11, the diameter of the catch basin 2 is several times larger than the diameter of sewer pipe 58. The device is not used, however, to drain fluids from the earth's surface, but rather is used as an apparatus to allow sewage from pipes 18 and 58 to be fed into the sewage pipes 1 and 41, respectively.

U.S. Pat. No. 1,948,931 to C. J. Mears also describes a catch basin (see FIG. 9) separating the inlet pipe 16 from the outlet pipe 17.

U.S. Pat. No. 3,729,165, a catch basin is illustrated as having a much larger diameter than the diameter of pipeline 44.

U.S. Pat. No. 3,938,285 to Agnar Gilbu is yet another example of a prior art manhole system using a larger diameter catch basin having cutouts 22 adapted to fit over a pipe or sewer line (FIG. 3).

Other examples of prior art drain systems and components of such systems are described in U.S. Pat. Nos. 5,645,372; 4,882,882; 4,127,990; 4,123,034; 3,860,214; 3,788,080; 3,695,153; 3,562,969; 3,436,051; 3,212,519; 3,136,024; 2,730,785; 2,650,411; 1,814,738; 1,720,503; 1,120,478 and 1,087,366.

Each of the foregoing prior art patents suffers from one or more shortcomings in failing to address a need for a drain system using small, portable, lightweight components which can be tapped into a drain pipe without the need for providing any additional support under the drain pipe, and which requires no severance or interruption of the drain pipe, and which forms the drain hole in the drain pipe before the other component or components are secured and sealed in place on the drain pipe.

OBJECTS OF THE INVENTION

It is therefor the primary object of the present invention to provide a drain system, and components therefor, requiring no severance or interruption of the drain pipe used with the system;

It is yet another object of the invention to provide a drain system and components therefor requiring no additional support under the drain pipe;

It is another object of the invention to provide a small, portable, lightweight drain system, and components therefor; and It is still another object of the invention to provide a new and improved method of installing a liquid drain system.

SUMMARY OF THE INVENTION

The objects of the invention are accomplished, generally, by a fluid drain system having a drain pipe, a drain hole cut or otherwise formed through the side wall of the drain pipe without completely severing the drain pipe, and a drain component housing then secured and sealed around said drain hole, said housing surrounding said drain hole and having a fluid channel through said housing, whereby fluid can drain through said channel into said drain pipe.

As a special feature of the invention, the drain component housing has an exterior lateral dimension which is less than or equal to the outside diameter of the drain pipe.

As another feature of the invention, a riser drain component housing is provided, stackable upon the top of said first drain component housing, having a fluid channel through said second housing, whereby fluid can sequentially drain through said riser drain housing and through said drain component housing into the said drain pipe.

As still another feature of the invention, a method for draining fluids comprises the steps of cutting or otherwise forming a drain hole in a drain pipe without severing the drain pipe, and then securing and sealing a drain component housing to said drain pipe surrounding said drain hole, said drain housing having an internal fluid channel therethrough, whereby fluid can drain through said fluid channel into said drain pipe.

As yet another feature of the invention, a method for draining fluid uses a drain component housing having an exterior lateral dimension which is less than or equal to the outside diameter of the drain pipe.

DETAILED DESCRIPTION OF THE PREFERRED EMBODIMENT

Figure 1:
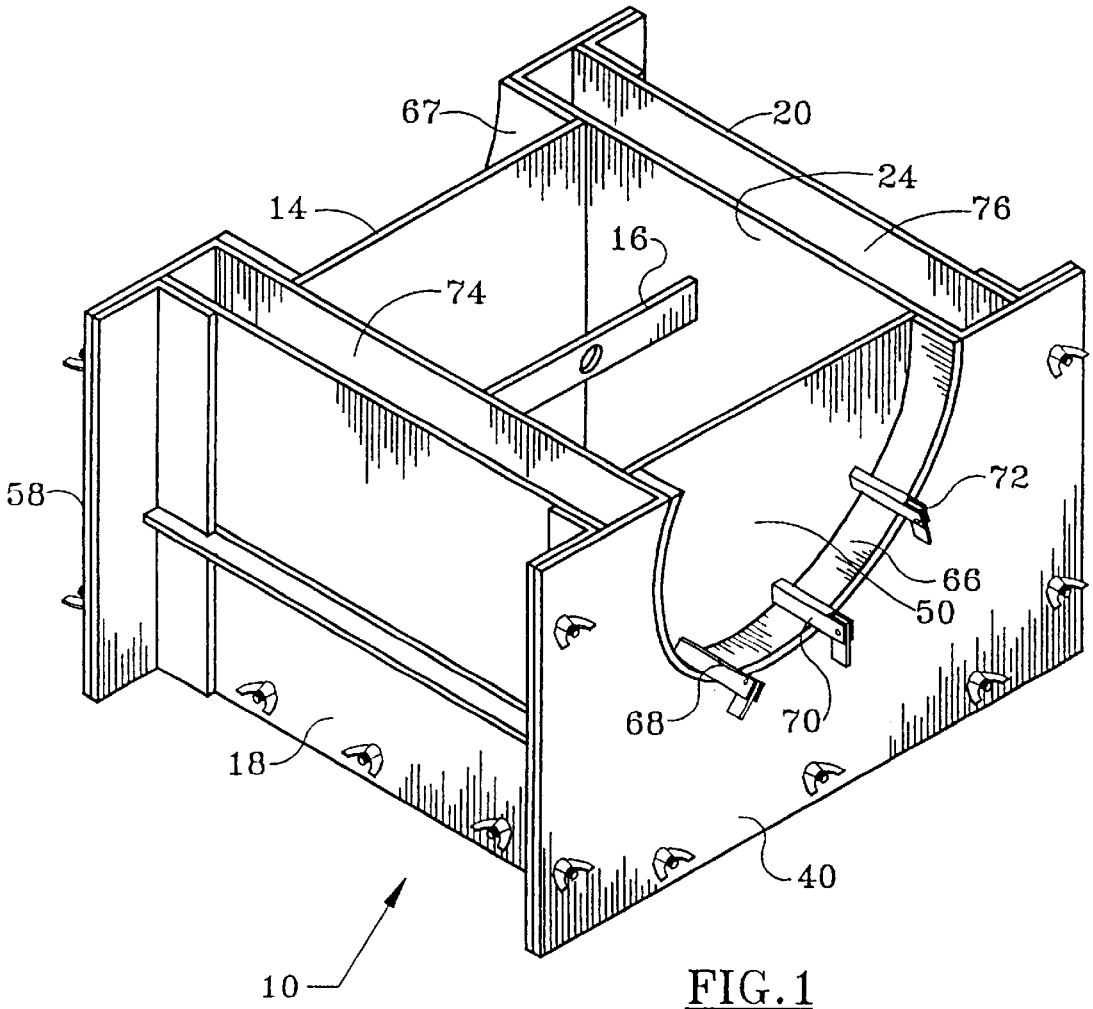
FIG. 1 is an isometric, pictorial view of a mold used to form a component of the drain system according to the invention.
Figure 2:
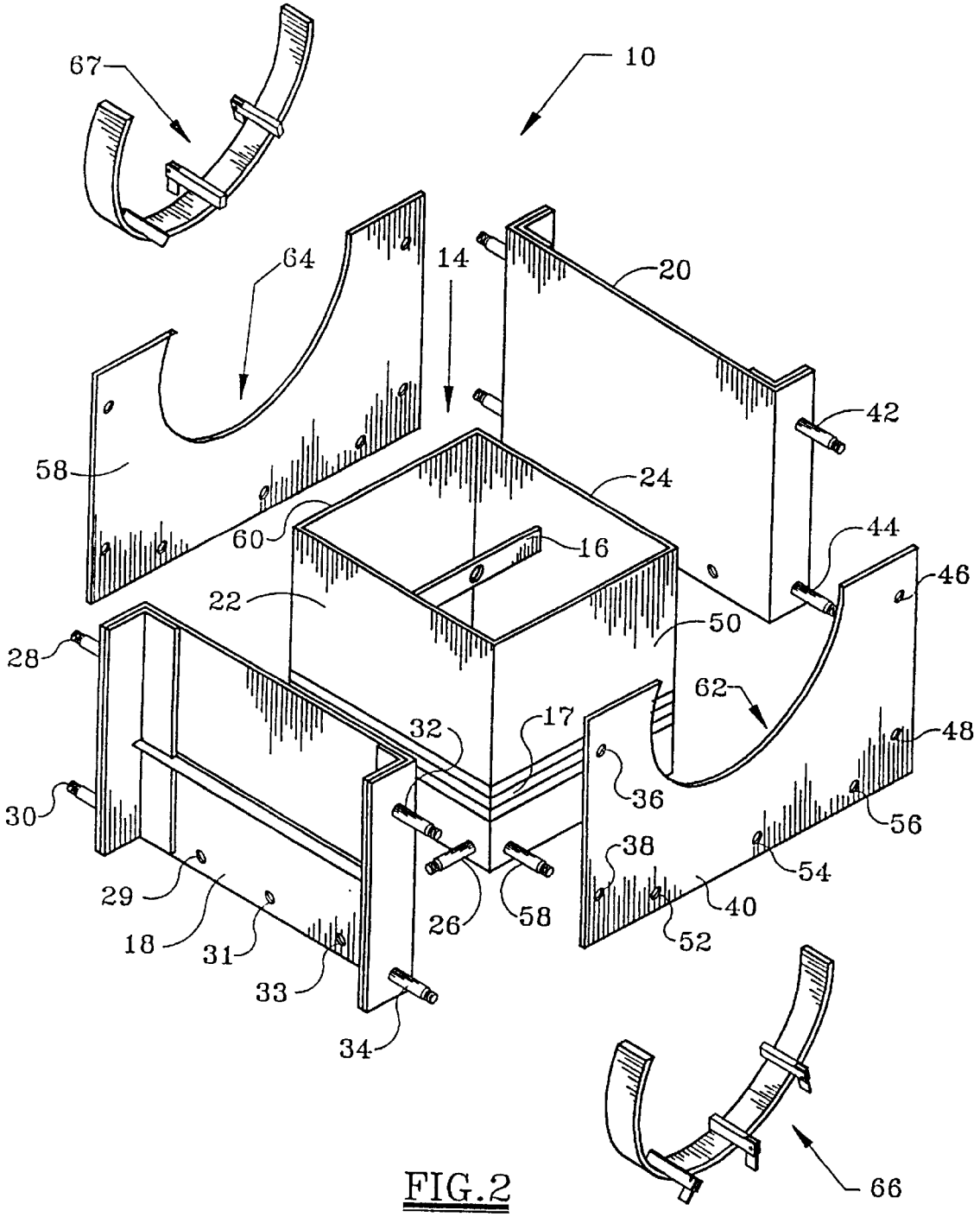
FIG. 2 is an exploded view of the mold illustrated in FIG. 1.
Figure 5:
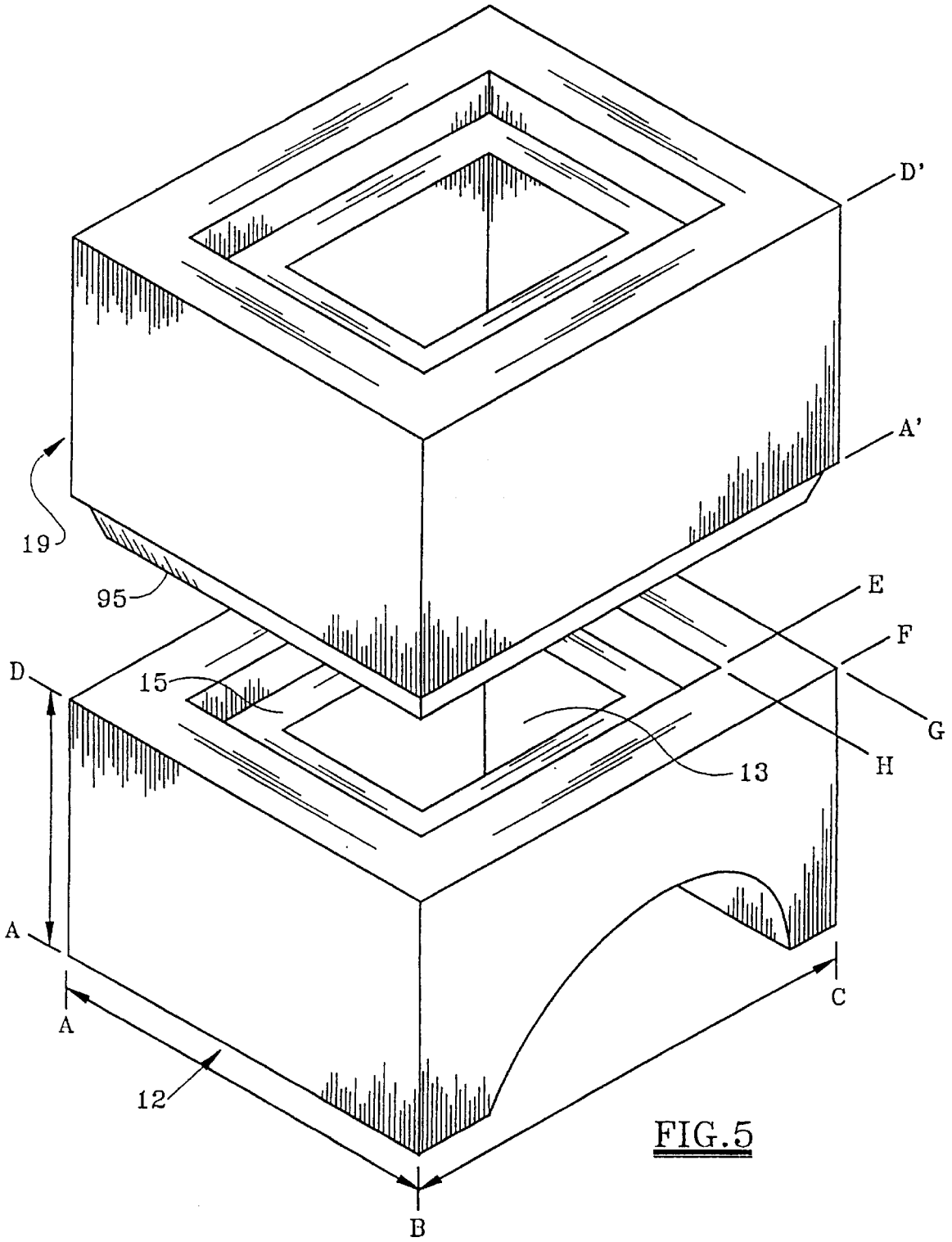
FIG. 5 is an exploded, isometric, pictorial view of a riser component in position to be installed on top of the primary drain component to increase the overall height of the drain components.

Referring now to the drawings in more detail, in FIGS. 1 and 2, there is illustrated a form 10 which can be used to pour the primary component 12 used in the drain system according to the present invention, the primary component 12 being illustrated, for example, in FIG. 5. The form 10 includes a box-shaped, four sided inner core 14, preferably having its opposite sides parallel to each other. One or more brace bars 16 are used within the interior of the inner core 14 to provide stability to the shape of the inner core 14.

A pair of u-shaped end plates 18 and 20 are spaced from a first pair of opposing sided walls 22 and 24, respectively, of inner core 14 by three threaded projections extending from each of the end plates 22 and 24, with only the threaded projection 26 being visible in FIG. 2. The three projections extending from side wall 22 are partially threaded to extend slightly through the three openings 29, 31 and 33 of side plate 18, while maintaining the side plate 18 spaced a predetermined distance from the side wall 22 of inner core 14. Female fasteners, for example, wing nuts, are used on the outside of end plate 18 to threadedly engage each of the three projections extending from the side wall 22 of the inner core 14, thereby securing the side plate 18 to the side wall 22, and maintaining the spacing therebetween. If desired, other forms of fasteners, for example, wedges and pins can be used to make the connections.

Side plate 20 is secured to the side wall 24 in a manner identical to that described above with respect to side plate 18 and side wall 22.

The side plate 18 has four partially threaded projections 28, 30, 32 and 34 extending laterally from the side plate 18. The threaded portions of extensions 32 and 34 extend slightly through a pair of openings 36 and 38, respectively, at the end plate 40. In an identical manner, partially threaded projections 42 and 44 extend slightly through openings 46 and 48 of end plate 40, where fasteners, for example, wing nuts, are used to connect the side plate 20 to the end plate 40.

Three partially threaded projections, with only extension 58 being illustrated, extend from the side wall 50 of inner core 14, and extend through three openings 52, 54 and 56, respectively, the end of which receive fasteners, for example, wing nuts, to maintain the end plate 40 spaced securely from the side wall 50.

End plate 58 is secured and spaced a predetermined distance from side wall 60 of inner core 14, in the identical manner to that described above with respect to end plate 40 and side wall 50.

The end plates 40 and 58 each have a partial circle cut-out, numbered 62 and 64, respectively, each cut-out having a radius of curvature to match the radius of curvature of the O.D. of a given pipe to which the component 12 will be secured, and sealed preferably with a water-tight seal.

A pair of stop-gap rings 66 and 67, configured to match the radius of curvature of the cut-outs 62 and 64, respectively, are secured to the cut-outs to prevent wet cement from escaping during the pouring process, using fasteners 68, 70 and 72 with the ring 66, and with three fasteners (not numbered) with the ring 67. The width of the stop-gap rings coincides with the width of the concrete end product coming out of the mold.

In using the form 10 to make the system component 12 (FIG. 5), once the form has been fastened together as illustrated in FIG. 1, liquid concrete is poured into the opening 74 between the side plate 18 and the side wall 22, and into the opening 76 between the side plate 20 and the side wall 24. These two pourings also fill the spaces between the end plate 40 and the side wall 50 and between the end plate 58 and the side wall 60.

Once the concrete has hardened, preferably with ambient air-drying, unless there are adverse temperatures and/or humidity conditions, the mold 10 is taken apart, leaving the component 12 in place once the inner core 14 is removed, a step which is preferably facilitated by fabricating the inner core walls from hard plastic, stainless steel, wood or the like.

An important feature of the present invention involves the dimension BC in FIG. 5 of the component 12. By using a mold 10 illustrated in FIGS. 1 and 2 configured to ensure that the dimension BC is no larger than the outside diameter (O.D.) of the drain pipe being fitted with the component 12, the drain system can be fabricated in most cases without the need for providing additional support under the drain pipe to handle the added weight of the component 12. While the dimension AB in FIG. 5 can vary, and even be longer or shorter than BC, the variation of either or both of the dimensions AB or BC will tend to enlarge or diminish the fluid drain capacity of the system but only if the hole to be cut in the drain pipe is made larger or smaller to coincide with changes in the through-hole 13 through the center of the component 12. As illustrated in FIG. 5, the through-hole 13 is surrounded by a ledge 15 to hold a grate (not illustrated). The ledge 15 is formed by having one or more external ridges 17 on the lower end of the side walls 22, 24, 50 and 60 of the inner core 14 illustrated in FIG. 2, with one or more of such ridges 17 also being used to make the internal surface above the ledge 15 sloped outwardly to facilitate accepting either a grate or the inwardly tapered surface 95 of FIG. 5.

The dimensions EF and GH can also be controlled to vary the weight of the component 12, and will preferably be fabricated as thin as possible to control the weight but not so thin as to compromise the structural integrity of the component 12. While the exact dimensions EF and GH are not critical to the present invention if, for example, if the component 12 is to be used with a 16 inch O.D. drain pipe, and the dimension BC is approximately 16 inches or slightly less, the dimensions EF and GH might be formed to be approximately 2–3" each.

The dimension AD can be formed as desired to accommodate the depth of the drain pipe below the earth's surface. If the dimension AD' does not bring the top surface of the component 12 high enough to reach the earth's surface, one or more of the riser units 19 illustrated in FIG. 5 can be stacked on top of the component 12. While the riser unit 19 can have varied dimensions, as can be the component 12, it is preferred that the dimensions of the riser unit 19 be the same as those of component 12, save and except possibly for the dimension A'D' which may different depending upon the needed overall height of the riser unit 19 to reach the earth's surface.

Figure 3:
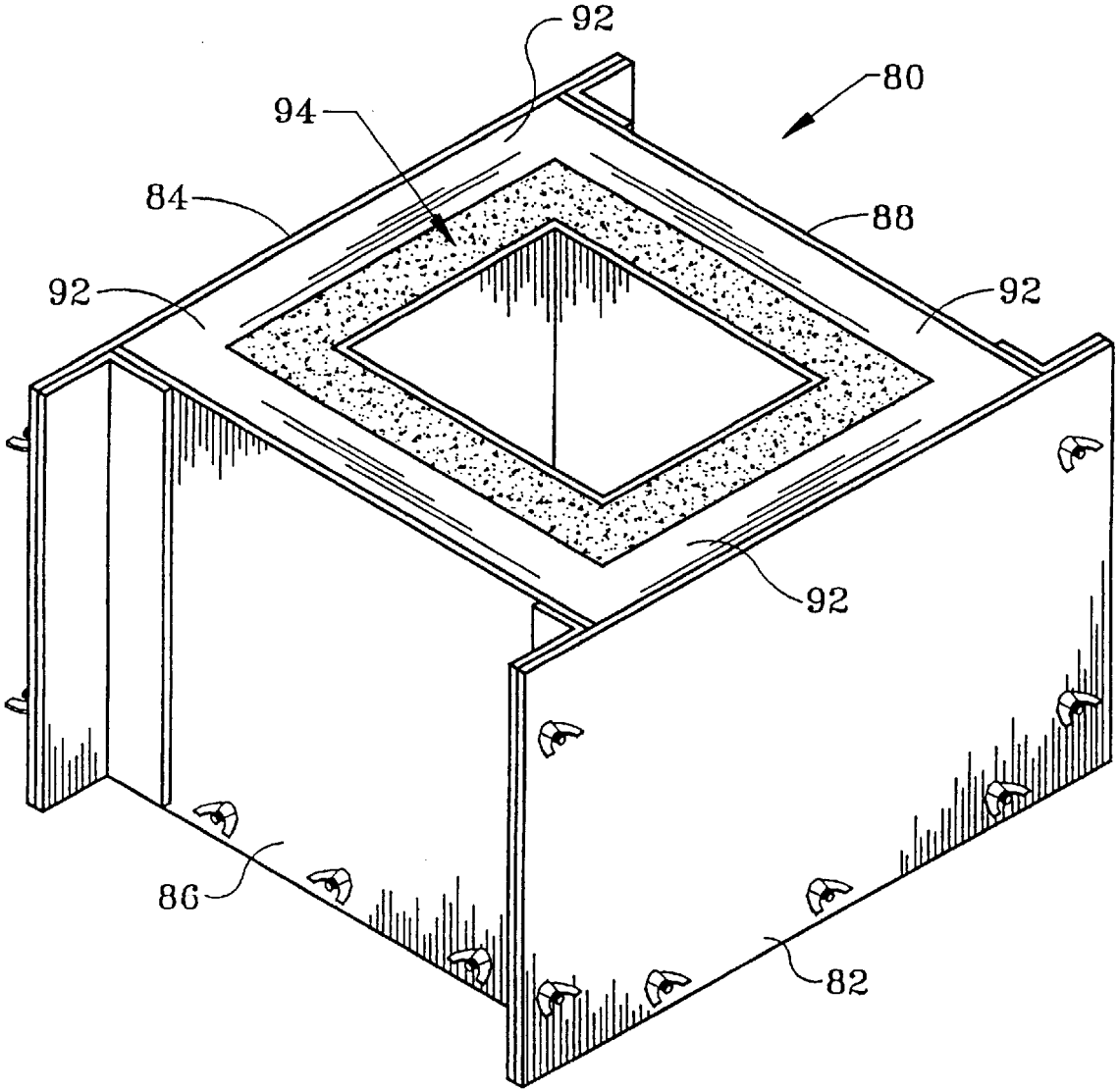
FIG. 3 is an isometric, pictorial view of a riser mold, similar to the mold illustrated in FIG. 1, but having no cut-outs for mating with the drain pipe.
Figure 4:
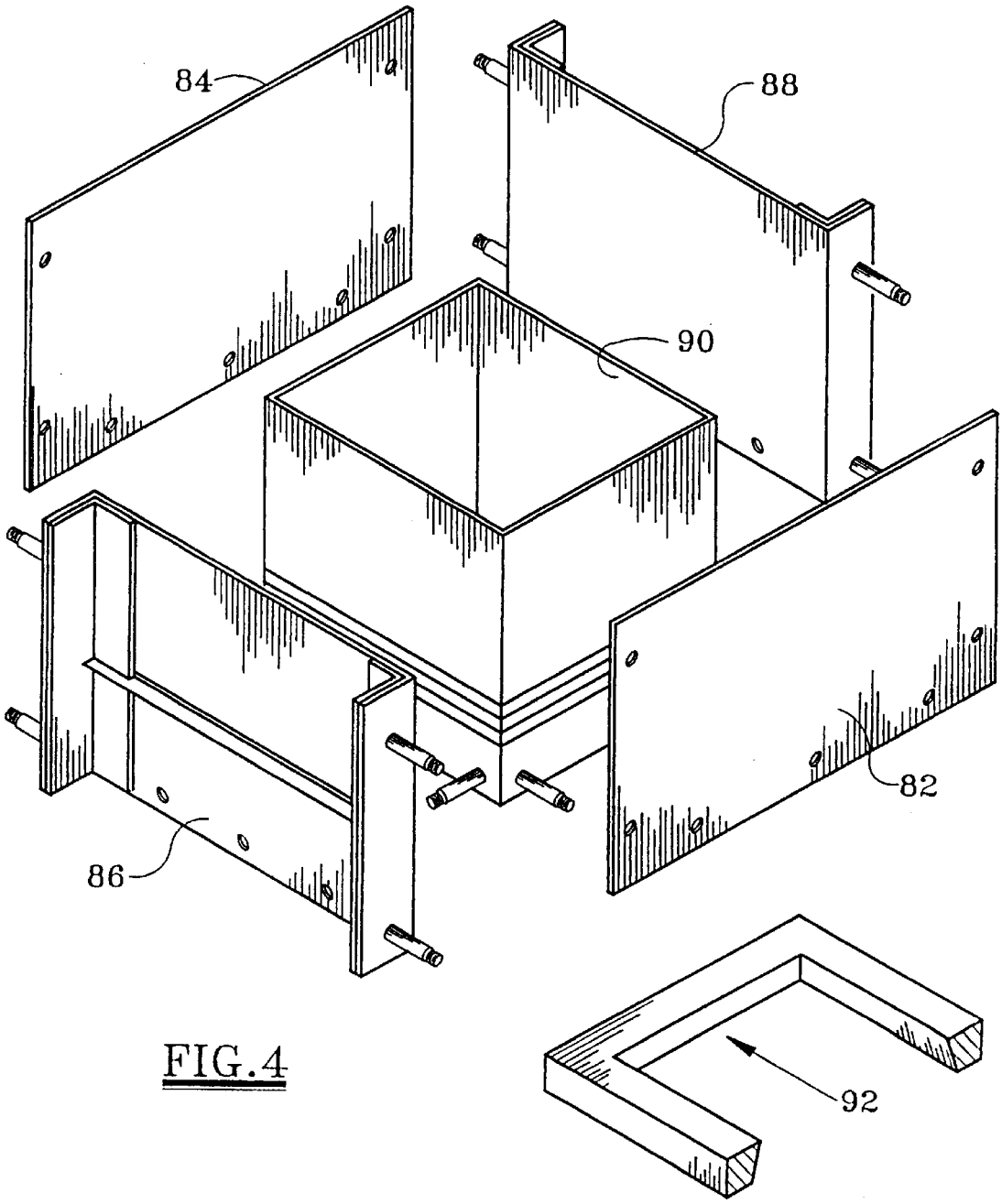
FIG. 4 is an exploded view of the mold illustrated in FIG. 3, with the riser mold of FIG. 3 opened, and the central core removed.

FIGS. 3 and 4 illustrate the mold 80 which can be used to pour the riser unit 19. The mold 80 functions essentially the same as mold 10, except for the end plates 82 and 84 not having the cut-outs to accommodate the drain pipe. The end plates 82 and 84, and the side plates 86 and 88 are attached to the inner core 90 in the same manner as discussed about with the respect to the side plates and end plates being attached to the inner core 14 in FIGS. 1 and 2.

A spacer bar 92, only one-half of which is illustrated in FIG. 4 to demonstrate the 45° angle, fits within the space between the inner core 90 and the plates 82, 84, 86 and 88, but rests only against each of those plates, without touching the inner core 90. The bar 90 fills only about one-half of the space between the inner core 90 and the plates 82, 84, 86 and 88, best illustrated in FIG. 3. The bar 92 can be supported within the space in any manner desired, for example, by adding extensions (not illustrated) extending outwardly from the side walls of the central core 90, positioned to cause the top surface of the spacer bar to coincide with the top surface of the poured cement 94.

After wet cement is poured into the remaining space between the central core 90 and the plates 82, 84, 86 and 88, and then allowed time to dry and harden, the mold 80 is taken apart, including the removal of the spacer bar 92 and of the inner core 90.

Because of the 45° angle created by the spacer bar 92, a beveled surface 95 is formed on the bottom of the riser unit 19, as illustrated in FIG. 5. The beveled surface 95 is configured to fit inside the through-hole fluid channel 13. Each of the molds 10 and 80 is poured upside down.

Figure 6:
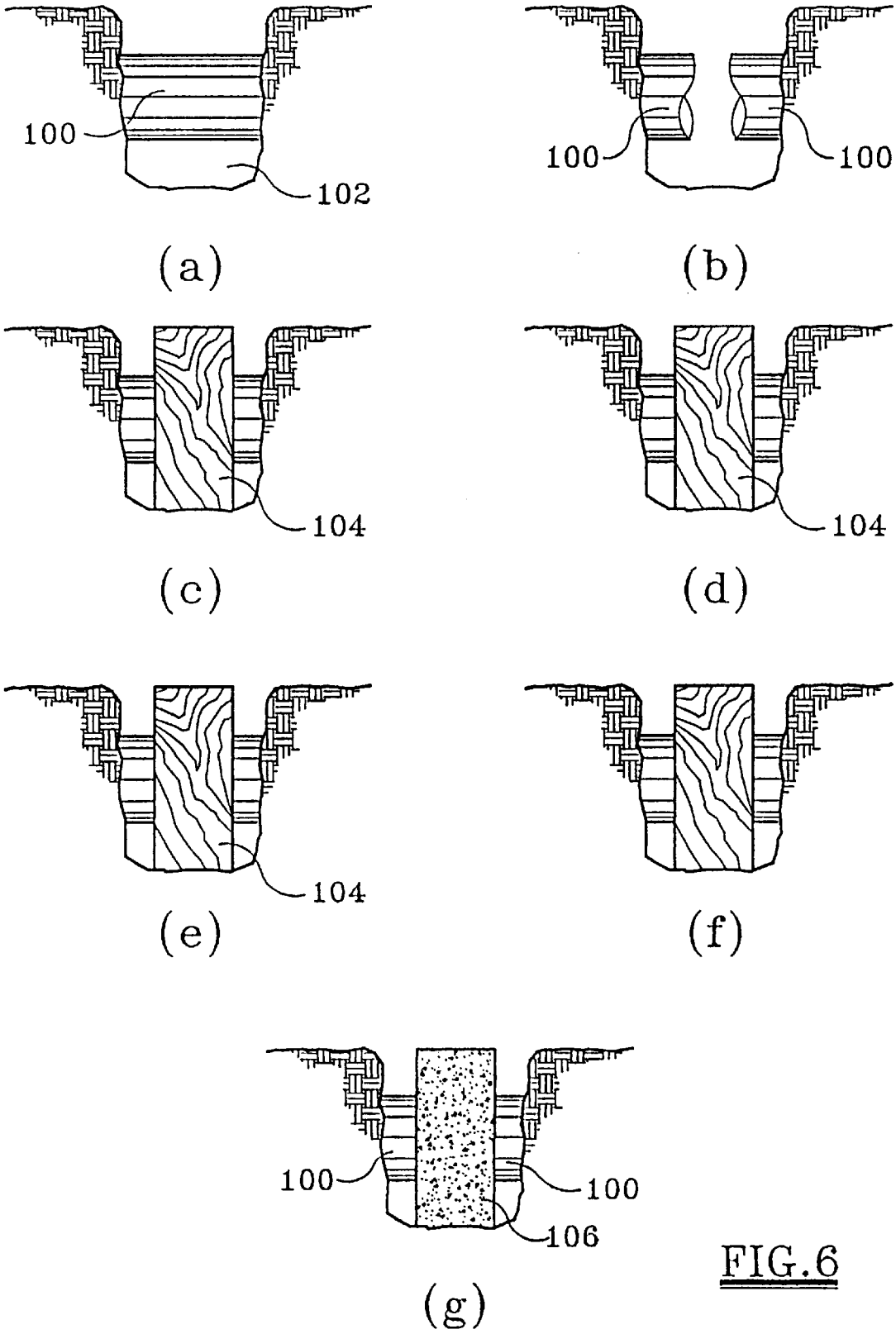
FIG. 6(*a–g*) graphically illustrates a prior art drain system.

FIG. 6 illustrates a typical prior art drain system. In FIG. 6(*a*), the drain pipe 100 is first located and the hole 102 goes all the way around the pipe 100, typically leaving part of the hole 102 beneath the pipe to allow the pipe to be cut in half, as illustrated in FIG. 6(*b*), and to allow a form to be built.

FIG. 6(*c*) illustrates the steps of the building a form 104, typically of plywood, which has to be purchased and hauled to the site, within which concrete will be poured to form a catch basin in fluid communication with the two ends of the cut drain pipe illustrated in FIG. 6(*b*).

FIG. 6(*d*) illustrates the steps of buying, cutting, and installing reinforcement under the drain pipe to bear the added weight.

FIG. 6(*e*) illustrates the steps of buying concrete, delivering the concrete to the site, and pouring the form.

FIG. 6(*f*) illustrates the step of removing the form 104 to leave intact the catch basin 106 (FIG. 6(*g*)).

FIG. 6(*g*) illustrates the step of covering the hole.

Figure 7:
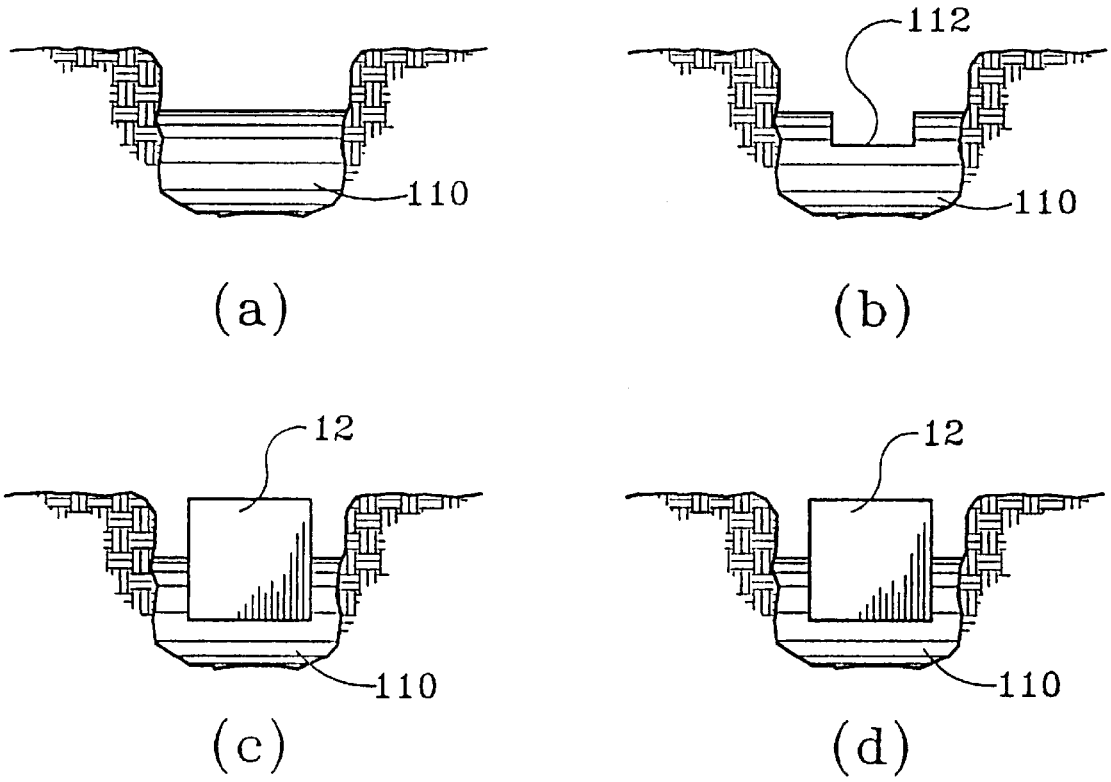
FIG. 7 graphically illustrates the system according to the present invention as a simple comparison of the systems of FIG. 6 and FIG. 7.

In sharp contrast to the labor intensive, prior art process described and illustrated in FIG. 6, FIG. 7 illustrates the system according to the present invention. In FIG. 7(*a*), the drain pipe 110 is located but typically only the upper portion of the pipe needs be uncovered.

In FIG. 7(*b*), a hole 112 is cut or otherwise formed into the surface of pipe 110, and can be made round, square, rectangular, or any other desired shape to provide fluid communication into the interior of the drain pipe 110, the only limitation being that the hole 112 must be smaller than the area defined by the exterior dimensions AB and BC of component 12 of FIG. 5.

FIG. 7(*c*) illustrates the component 12 being placed over the hole 112 and secured in place to the drain pipe 110 by mortar, concrete, or cements of various types or the like, to provide a water-tight seal around the hole 112.

FIG. 7(*d*) illustrates covering the hole.

Figure 8:
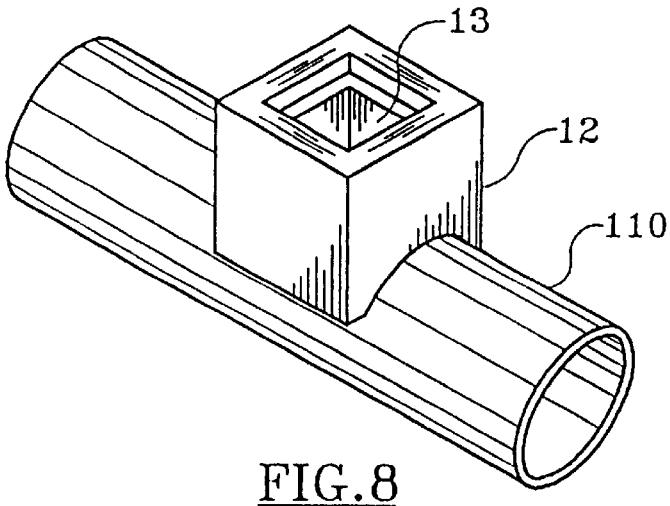
FIG. 8 is a isometric, pictorial view of the drain system according to the present invention.

FIG. 8 illustrates, pictorially, an isometric view of the component 12 secured to a drain pipe 110, an installation in which a hole 112 (FIG. 7(*b*)) is in fluid communication with the through-hole 13, also illustrated in FIG. 5. If the top surface of the component 12 does not reach a desired height, for example, the earth's surface, one or more riser units 19 can be stacked on top of the component 12 to reach the desired height.

What is claimed is:

1. A fluid drain system comprising:

a drain pipe having a central pipe axis and a side wall and having at least one drain hole through said side wall, said at least one drain hole being formed in said sidewall without completely severing said drain pipe; and a first drain component housing secured and sealed to an exterior surface of said drain pipe curved within a plane perpendicular to the central pipe axis and surrounding said at least one drain hole, after said at least one drain hole has been formed in said sidewall of said drain pipe, said housing having a lateral dimension in a direction perpendicular to the central pipe axis, the lateral dimension being no greater than an exterior lateral drain pipe dimension at the general location of the said least one drain hole, said housing having, a fluid channel therethrough, the curved exterior surface of the drain pipe supporting the housing thereon, whereby fluid can drain through said channel into said drain pipe.

2. A method for draining fluids from the earth's surface, comprising:

forming at least one drain hole in a drain pipe while positioned beneath the earth's surface without completely severing the drain pipe, the drain pipe having a central pipe axis; and securing and sealing a first drain component housing to said drain pipe surrounding said at least one drain hole, after said at least one drain hole has been formed in said sidewall of said drain pipe, such that said housing is supported on an exterior surface of said drain pipe curved within a plane perpendicular to the central pipe axis, said first drain component housing having a lateral dimension in a direction perpendicular to the pipe axis, the lateral dimension being no greater than an exterior lateral drain pipe dimension, the housing having an internal fluid channel therethrough extending from said at least one drain hole to the earth's surface, whereby fluid at the earth's surface can drain through said fluid channel into said drain pipe.

3. The system according to claim 1, including in addition thereto, a riser drain component housing, stacked upon the top of said first drain component housing, having a fluid channel through said riser housing whereby fluid can drain through said riser housing and through said first housing into said drain pipe.

4. The system according to claim 3, wherein the riser drain component housing has an exterior lateral dimension which is less than or equal to the outside diameter of the drain pipe at the general location of the said least one drain hole.

5. A method for draining fluids from the earth's surface, comprising:

forming at least one drain hole in a drain pipe while positioned beneath the earth's surface without completely severing the drain pipe, the drain pipe having a central pipe axis; securing and sealing a first drain component housing to said drain pipe surrounding said at least one drain hole, after said at least one drain hole has been formed in said sidewall of said drain pipe, such that the said housing is supported on an exterior surface of said drain pipe curved within a plane perpendicular to the central pipe axis, said first drain component housing having an internal fluid channel therethrough, the housing having an upper outer ridge surrounding an inner ledge to facilitate acceptance of the riser drain component; stacking a riser drain component housing on top of said first drain component housing, said riser housing having a lateral dimension in a direction perpendicular to the pipe axis, the lateral dimension being no greater than an exterior lateral drain pipe dimension, the riser drain component having a lower outer surface for planar engagement with the upper outer ridge of the housing and a lower inner ledge for planar engagement with the inner surface of the housing, the housing having an internal fluid channel therethrough extending from the earth's surface to the top end of the fluid channel in said first drain component housing, whereby fluid at the earth's surface can sequentially drain through the fluid channels in each of the housings into the drain pipe.

6. The system according to claim 1, wherein an upper surface of the housing is configured with ridges surrounding a ledge to facilitate acceptance of a grate.

7. The system according to claim 2, wherein the housing is configured within upper an outer ridge surrounding an inner ledge to facilitate acceptance of the riser drain component.

8. The system according to claim 2, wherein the riser drain component is configured with a riser ridge surrounding a riser ledge to facilitate acceptance of a grate.

9. The system according to claim 1, wherein the housing has a lower curved surface configured to planar engagement with the radius of curvature of the curved exterior surface of the drain pipe.

10. The method according to claim 4, wherein the first drain component housing is fabricated at a location remote from the drain pipe and is subsequently transported to the location of the drain pipe.

11. The method according to claim 4, further comprising:

uncovering the drain pipe then forming the drain hole through said sidewall.

12. The method according to claim 4, wherein the first drain component has a lower curved surface configured for planar engagement with the radius of curvature of the curved exterior surface of the drain pipe.

13. The method according to claim 4, further comprising:

configuring the housing with an upper outer ridge surrounding an inner ledge to facilitate acceptance of a riser drain component.

14. The method according to claim 5, wherein each of the first drain component housing and the riser housing is fabricated at a location remote from the drain pipe and is subsequently transported to the location of the drain pipe.

15. The method according to claim 5, wherein the first drain component has a lower curved surface configured for planar engagement with the radius of curvature of the curved exterior surface of the drain pipe.

16. The method according to claim 5, further comprising:

forming the housing with an upper outer ridge surrounding an inner ledge to facilitate acceptance of the riser drain component.

17. The method according to claim 5, further comprising:

uncovering the drain pipe then forming the drain hole through said sidewall.

18. The method according to claim 5, further comprising:

forming a riser ridge and a ledge in the riser drain component to facilitate acceptance of a grate.

* * * * *

UNITED STATES PATENT AND TRADEMARK OFFICE

CERTIFICATE OF CORRECTION

PATENT NO. : 6,106,196

DATED : August 22, 2000

INVENTOR(S) : Clyde Hantz, Jr. and Jonathan P. Hantz

It is certified that error appears in the above-identified patent and that said Letters Patent are hereby corrected as shown below:

In Column 7, line ll, change "Claim 2" to --Claim 3--.

In Column 7, line 15, change "Claim 2" to --Claim 3--.

In Column 7, line 22, change "Claim 4" to --Claim 2--.

In Column 7, line 26, change "Claim 4" to --Claim 2--.

In Column 8, line 1, change "Claim 4" to --Claim 2--.

In Column 8, line 5, change "Claim 4" to --Claim 2--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*